US006210202B1

(12) United States Patent
Kuo

(10) Patent No.: US 6,210,202 B1
(45) Date of Patent: Apr. 3, 2001

(54) DEVICE FOR LOCKING TWO MATING CONNECTORS

(75) Inventor: Peter Kuo, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/442,105

(22) Filed: Nov. 17, 1999

(30) Foreign Application Priority Data

Dec. 24, 1998 (CN) ..... 087221551

(51) Int. Cl.[7] ..... H01R 13/627
(52) U.S. Cl. ..... 439/358
(58) Field of Search ..... 439/350–358

(56) References Cited

U.S. PATENT DOCUMENTS 5,383,794 * 1/1995 Davis et al. ..... 439/357
5,588,864 * 12/1996 Lin ..... 439/357
5,599,207 * 2/1997 Lai ..... 439/357
5,741,150 * 4/1998 Stinson et al. ..... 439/358
5,775,931 * 7/1998 Jones ..... 439/358
5,860,826 * 1/1999 Chang ..... 439/358
5,941,726 * 8/1999 Koegel et al. ..... 439/358

* cited by examiner

*Primary Examiner*—Gary F. Paumen
(74) *Attorney, Agent, or Firm*—Wei Te Chung

(57) ABSTRACT

A locking device for joining first and second mating connectors together comprises a pair of first locking members and a pair of second locking members respectively retained in opposite sides of the first and second connectors. Each first locking member has a globular engaging portion extending beyond the first connector. Each second locking member has a latch extending beyond the second connector which includes an opening and a transverse bar at a free end thereof. The transverse bar defines an inclined surface and has an arcuate construction for facilitating guidance of a corresponding engaging portion of the first locking member into the opening of the latch. The pair of engaging portions of the first locking members is accommodated in the pair of openings of the second locking members, thereby securely engaging the first and second locking members together.

1 Claim, 4 Drawing Sheets

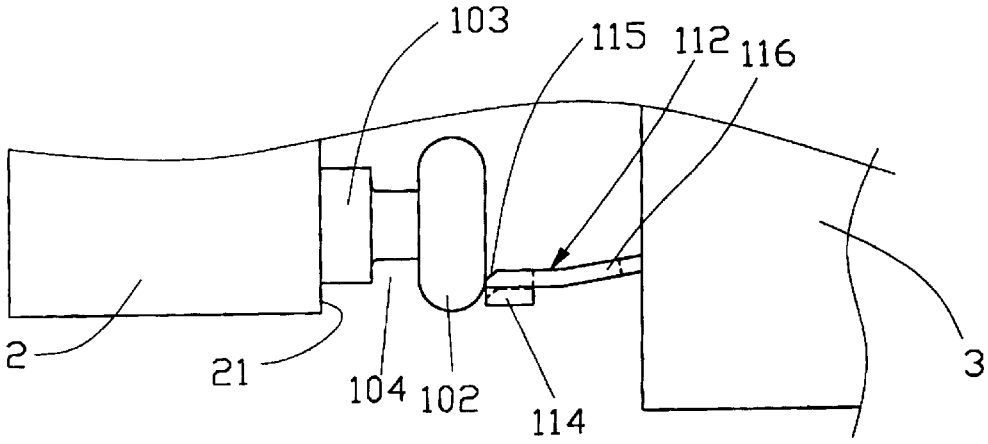
FIG. 3A
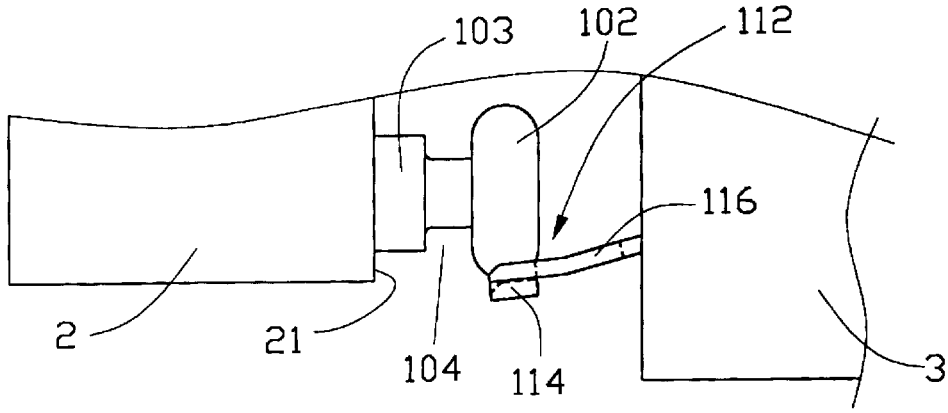
FIG. 3B
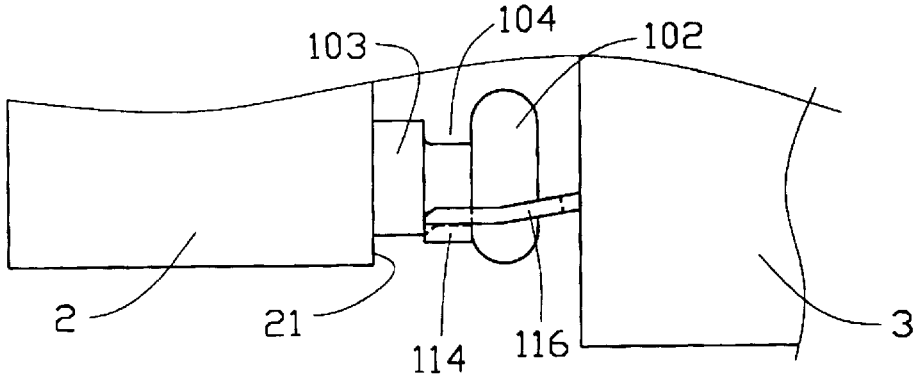
FGI. 3C

DEVICE FOR LOCKING TWO MATING CONNECTORS

BACKGROUND OF THE INVENTION

1. Field of the Invention

The present invention relates to a locking device for joining first and second mating connectors together.

2. Description of the Prior Art

Electrical connection between two mating connectors is often adversely effected by vibration or an unexpected external force. In order to protect the connection from such disturbances, the mating connectors often have engageable locking devices for securely joining the two connectors together. U.S. Pat. Nos. 5,401,189 and 5,971,790, and Taiwan Patent Application No. 84201383 disclose such connectors.

Referring to FIG. 4, a conventional connector comprises a dielectric housing 70, a plurality of conductive contacts 71 received in the housing 70, a shield 72 enclosing a front portion of the housing 70 and a pair of locking members 73 for joining the connector and a mating connector (not shown) together. The housing 70 defines a pair of apertures 74 in opposite sides thereof for securely receiving the corresponding locking members 73. The shield 72 defines a pair of cutouts 78 and a pair of through holes 79 at positions corresponding to the apertures 74 of the housing 70. Each locking member 73 forms a cantilevered arm 76 having a hook 77 at a free end thereof and a cavity 75 corresponding respectively to the cutout 78 and the through hole 79 of the shield 72. Each locking member 73 is received in the corresponding aperture 74 of the housing 70 with the arm 76 extending through the corresponding cutout 78 of the shield 72. The locking member 73 is attached to the housing 70 and the shield 72 by a fastening member such as a screw (not shown), extending through the cavity 75 and the through hole 79.

However, since the locking member 73 is relatively large, the aperture 74 of the housing 70 weakens the integrity of the housing 70. In addition, since the hook 77 only engages with a locking member of the mating connector (not shown) at a predetermined position, any deviation therebetween will hinder proper engagement. Further, disengagement between the two mated connectors is complicated since the locking members 73 are not provided with an accessible disengaging device. Hence, an improved electrical connector is required to overcome the disadvantages of the prior art. The copending applications of Ser. Nos. 09/361,686 filed Jul. 27, 1999 and 09/364,172 filed Jul. 07, 1999 both of which have the same inventor and the same assignee with the invention, disclose some approaches.

BRIEF SUMMARY OF THE INVENTION

A first object of the present invention is to provide a locking device having effective guiding means for locking/unlocking two members of the locking device with a minimal force.

A second object of the present invention is to provide a locking device which occupies a small amount of space in an insulative housing of an electrical connector in which the locking device is assembled.

To fulfil the above objects, a locking device for joining first and second mating connectors together comprises a pair of first locking members and a pair of second locking members respectively retained in opposite sides of the first and second connectors. Each first locking member has a globular engaging portion extending beyond the first connector. Each second locking member has a latch extending beyond the second connector which includes an opening and a transverse bar at a free end thereof. The transverse bar defines an inclined surface and has an arcuate construction for facilitating guidance of a corresponding engaging portion of the first locking member into the opening of the latch. The pair of engaging portions of the first locking members is accommodated in the pair of openings of the second locking members, thereby securely engaging the first and second locking members together.

Other objects, advantages and novel features of the invention will become more apparent from the following detailed description of the present embodiment when taken in conjunction with the accompanying drawings.

BRIEF DESCRIPTION OF THE DRAWINGS

FIGS. 3A–3C are partial top views showing two locking members of the locking device in accordance with the preferred embodiment of the present invention being sequentially engaged together.

DETAILED DESCRIPTION OF THE INVENTION

Figure 1:
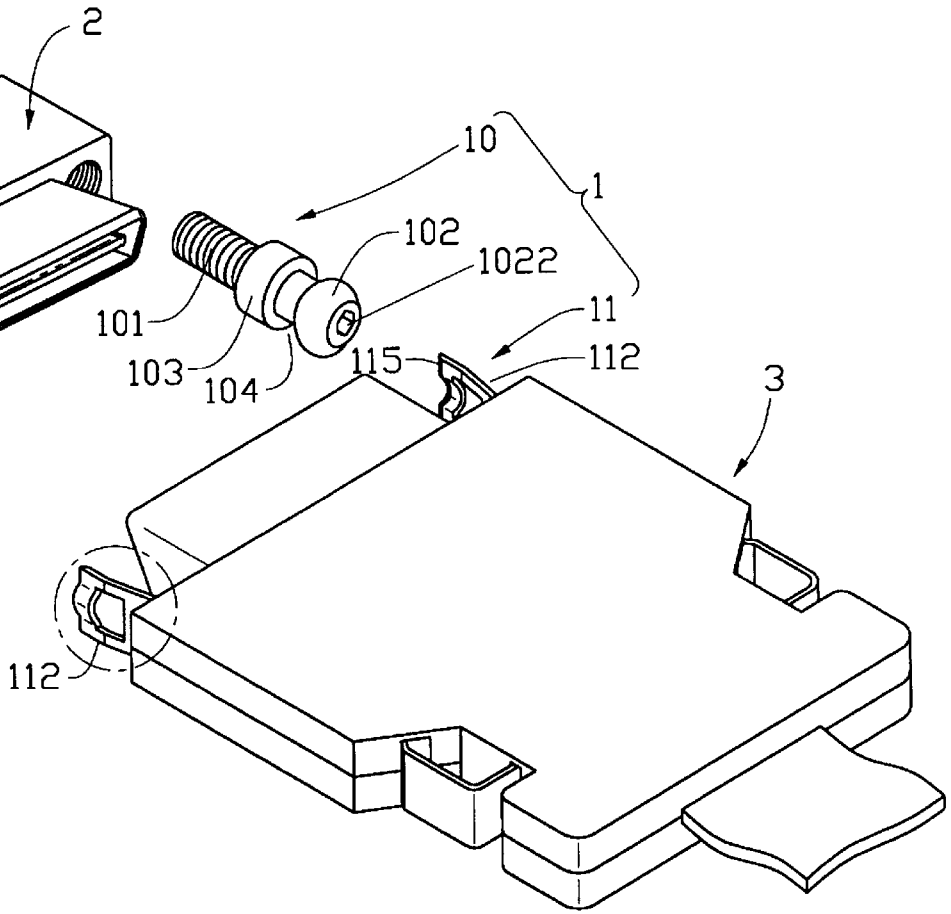
FIG. 1 is an exploded view of two mating electrical connectors and a pair of locking devices in accordance with a preferred embodiment of the present invention.
Figure 1A:
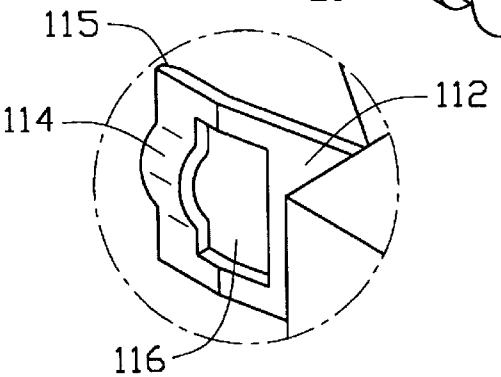
FIG. 1A is a partial enlarged view of FIG. 1.
Figure 2:
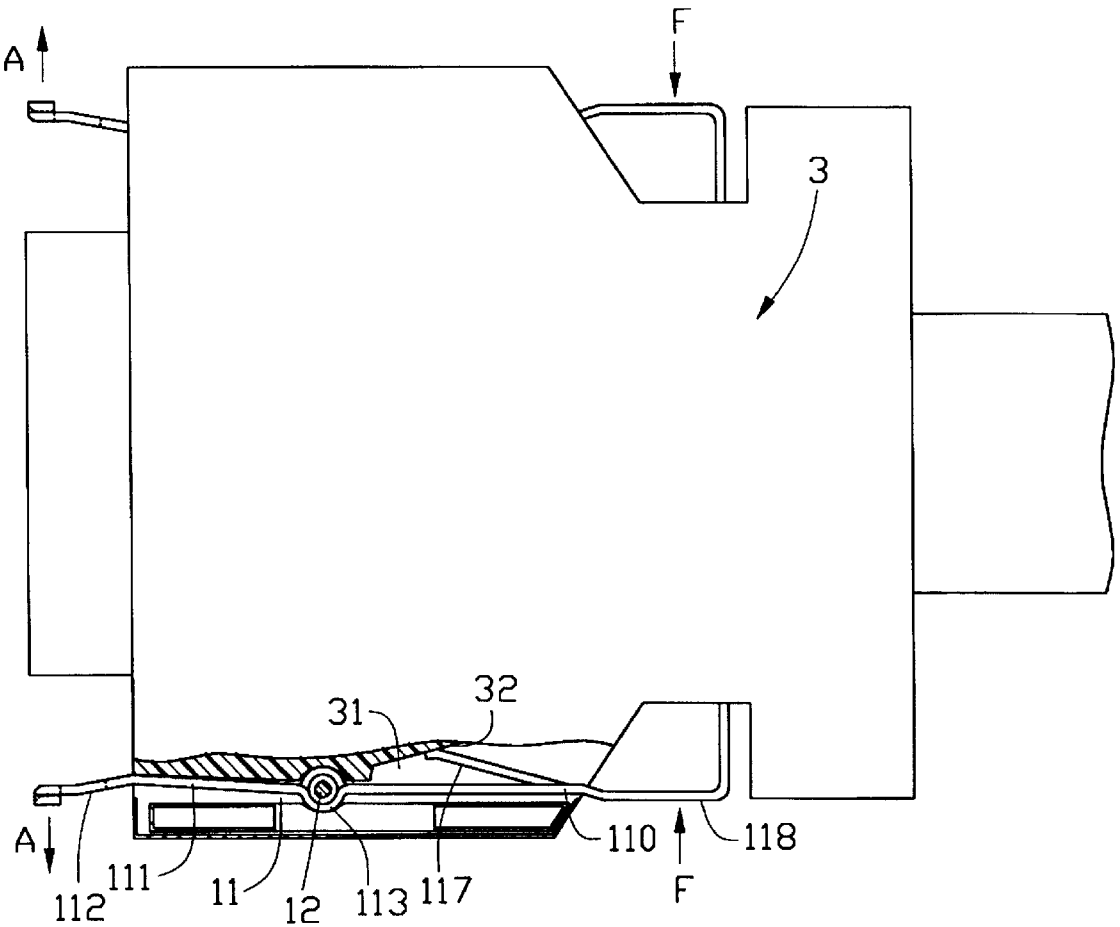
FIG. 2 is a partially cross-sectional top view of an assembly of one of the two mating electrical connectors and a pair of second locking members shown in FIG. 1.
Figure 4:
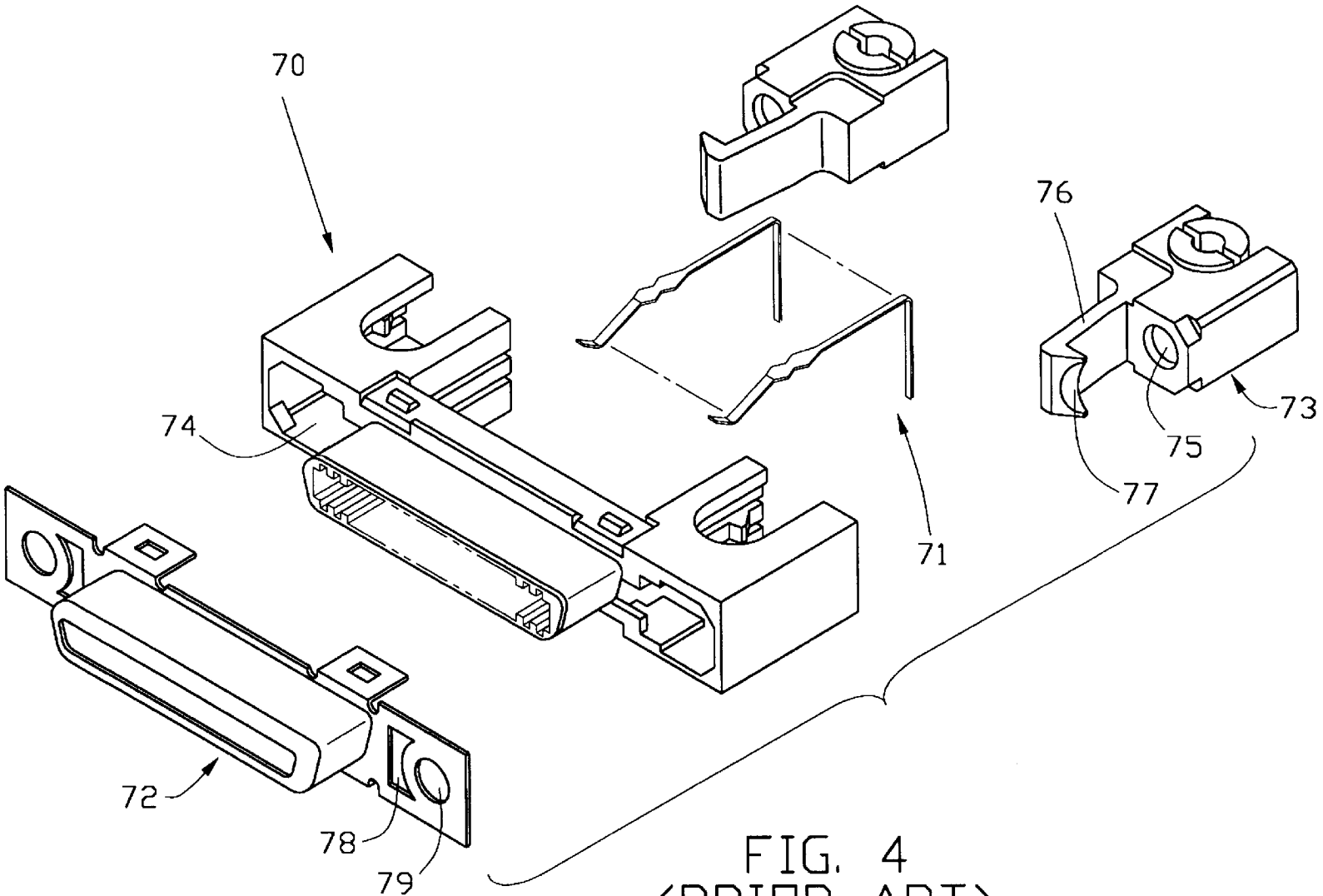
FIG. 4 (PRIOR ART)
FIG. 4 is an exploded view of an electrical connector incorporating a conventional locking device.

Referring to FIGS. 1, 1A and 2, a locking device 1 for joining a first connector 2 and a second connector 3 together comprises a pair of first locking members 10 and a pair of second locking members 11 retained in the first and second connectors 2, 3, respectively. The first locking member 10 has a screw portion 101 forming threads thereon and an engaging portion 102, generally having a globular construction, opposite the screw portion 101. The screw portion 101 is received in the first connector 2 while the engaging portion 102 extends beyond a mating face 21 of the first connector 2. A projection 103 is formed proximate the engaging portion 102, and a gap 104 is defined therebetween. The engaging portion 102 defines a hexagonal opening 1022 at a free end thereof for screwing the screw portion 101 of the first locking member 10 into the first connector 2. In a preferred embodiment of the present invention, each of the pair of second locking members 11 comprises a rear portion 110, a front portion 111 and a fulcrum portion 113 positioned between the rear and front portions 110, 111 (best seen in FIG. 2). The rear portion 110 comprises a resilient strip 117 stamped laterally therefrom and a press portion 118 exposed out of the second connector 3 for manually operating the second locking member 11. The fulcrum portion 113 is ring-shaped for receiving and rotating about a fulcrum bar 12 in the second connector 3. Correspondingly, the second connector 3 defines a channel 31 in each of the opposite side edges thereof for movably accommodating the pair of second locking members 11 therein. In an unengaged state, the resilient strip 117 of each second locking member 11 resiliently abuts against an inner peripheral wall 32 of the channel 31 to render the front portion 111 inwardly pivotable about the fulcrum bars 12.

The front portion 111 comprises a latch 112 extending beyond a mating face (not labeled) of the second connector 3 for engaging with the engaging portion 102 of the first locking member 10. The latch 112 includes an opening 116 and a transverse bar 114 at a free end thereof. The transverse bar 114 generally extends in a front-to-back or mating direction with regard to the connectors 2, 3, which is different from the exposed front portion 111 of the latch 112 which extends forward and outwardly in an oblique direction. The transverse bar 114 further defines an inclined surface 115 in a lateral and distal edge thereof for slidably guiding a selected one of the engaging portions 102 of the first locking members 10 into the opening 116 of the latch 112. The transverse bar 114 is laterally stamped to form an arcuate construction for facilitating guidance of the selected engaging portion 102 of the first locking member 10 into the opening 116.

Also referring to FIGS. 3A–3C, in operation, a forces F is exerted on the press portions 118 of each second locking members 11 to inwardly move the rear portion 110 which causes an outward movement of the front portions 111 (shown by arrows A) because of the presence of the fulcrum portion 113 and the fulcrum bar 12, thereby facilitating the engagement of the engaging portions 102 of the pair of first locking members 10 with the front portions 102 of the pair of second locking members 11. The front portions 111 generally resume to their original positions when the forces F is removed from the rear portions 110 due to the functions of the resilient strips 117 of the rear portions 110. In this case, the engaging portions 102 of the pair of first locking members 10 are received in the openings 116 of the latches 112 of the pair of second locking members 11 and the transverse bars 114 are received in the gaps 104 of the pair of first locking members and abut against rear portions of the engaging portions 102, thereby secure engagement of the pair of first locking members 10 with the pair of second locking members 11 is obtained.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A locking device for engaging first and second mating connectors together, comprising:

a pair of first locking members retained in a first connector, each of the pair of first locking members forming an engaging portion at a free end thereof; and a pair of second locking members retained in a second connector, each second locking member having a latch including an opening and a transverse bar at a free end thereof, the latch being resiliently displaceable in a sideward direction to permit the engaging portion of the respective first locking member to partially enter the opening of the latch, thereby enabling the transverse bar to abut against a rear portion of the engaging portion;

wherein the transverse bar of each latch defines an inclined surface in a lateral and distal edge thereof for smoothly guiding the selected engaging portion of the first locking member into the opening of the latch;

wherein the transverse bar is laterally stamped to form an arcuate portion for facilitating guidance of the selected engaging portion of the first locking member into the opening of the latch;

wherein the engaging portion of the first locking member has a rounded construction in conformity with the arcuate portion of the second locking member;

wherein each of the pair of second locking members further comprises a fulcrum portion about which the pair of second locking members is pivotable in the second connector;

wherein each of the pair of second locking members comprises a resilient strip by which the latches of the pair of second locking members are biased to move toward the engaging portions of the pair of first locking members.

* * * * *